United States Patent [19]

Ishii

[11] 4,163,898

[45] Aug. 7, 1979

[54] METHOD OF FORMING RADIOGRAPHIC IMAGES

[75] Inventor: Tetsuo Ishii, Ebina, Japan

[73] Assignee: Fuji Xerox Co., Ltd., Tokyo, Japan

[21] Appl. No.: 850,318

[22] Filed: Nov. 10, 1977

[51] Int. Cl.[2] ..... G03G 13/00

[52] U.S. Cl. ..... 250/315 R; 250/315 A

[58] Field of Search ..... 250/315 R, 315 A

[56] References Cited

U.S. PATENT DOCUMENTS 3,978,335 8/1976 Gibbons ..... 250/315 A

*Primary Examiner*—Craig E. Church

*Attorney, Agent, or Firm*—Sughrue, Rothwell, Mion, Zinn and Macpeak

[57] ABSTRACT

A method of forming a radiographic image uses the phenomenon that some substances emit exoelectrons when exposed to heating or to irradiation of light after first being irradiated by X-rays. First, X-rays are irradiated through a subject to an exoelectron emitting member consisting of a conductive base plate and a layer of exoelectron emitting substance superposed thereon. Subsequently, the surface of the exoelectron emitting member is coated with a charge injection liquid and a nonconductive sheet is placed in intimate contact with the charge injection liquid. The insulating sheet is coated with a conductive liquid, and a conductive electrode is superposed thereon. The laminate is then exposed to heating or to irradiation of light while applying a voltage between the conductive base plate and the conductive electrode. If light irradiation is used, it is directed onto the conductive electrode which must be transparent. In either case, an electrostatic latent image is formed on the insulating sheet.

2 Claims, 7 Drawing Figures

METHOD OF FORMING RADIOGRAPHIC IMAGES

BACKGROUND OF THE INVENTION

Some substances emit electrons when exposed to heating or to irradiation of light after first being irradiated by X-rays or other radiation rays (referred to simply as X-rays hereinafter). The emitted electrons are called as exoelectrons.

This invention concerns a novel method of forming X-ray images making use of this phenomenon. Methods of forming X-ray images known so far include exposure of a conventional silver halide emulsion film to X-rays to obtain images containing silver particles in the silver halide emulsion, a xeroradiographic method utilizing the X-ray sensitivity of photoconductors, an ionographic method utilizing the ionization phenomenon of gas or insulating liquid confined between electrodes opposing each other and the like. The method of using silver halide emulsion film has, however, a disadvantage that the process is laborious and takes much processing time, as well as results in waste liquor containing noxious substances because chemical treatments are necessary in each of the stages of development and fixing. Moreover, this method is not very suitable to form X-ray images from soft tissue parts of a body such as muscles, stomach, intestines and the like although suited to form images from skeletal regions or hard tissue parts such as the head, chest, hands and arms, feet and the like.

In xeroradiography or ionography wherein the X-ray images for the object to be inspected are obtained as electrostatic latent images in proportion to the amount of the X-rays transmitted through the object, satisfactory images are obtainable being highly descriminative of the soft parts where the contrast is relatively low due to the edge effect well known in the art of the electrophotography. The xeroradiography however has a defect that sensitivity is not good because the photon efficiency of photoconductors is generally low thereby presenting problems such as excess radiation dose to objects. In ionography wherein ion pairs are produced from gas or insulating liquid confined in the gap between opposing electrodes and drifted to the electrode at the absorption of X-rays, resolving-power is decreased by the scattering of secondary electrons, or the apparatus becomes voluminous and complicated because of the requirements for keeping air tightness in a gas ionographic device or stable insulation in a liquid ionographic device.

SUMMARY OF THE INVENTION

This invention has been accomplished in view of the defects described above and provides a method of forming X-ray images of high resolving power and sensitivity by easy procedures and with simple apparatus.

According to the present invention, a radiographic image is formed by first irradiating X-rays through a subject to an exoelectron emitting member consisting of a conductive base plate and a layer of exoelectron emitting substance superposed thereon. Sebsequently, the surface of the exoelectron emitting member is coated with a charge injection liquid and a insulating sheet is placed in intimate contact with the charge injection liquid. The insulating sheet is coated with a conductive liquid, and a conductive electrode is superposed thereon. The laminate is then exposed to heating or to irradiation of light while applying a voltage between the conductive base plate and the conductive electrode. If light irradiation is used, it is directed onto the conductive electrode which must be transparent. In either case, an electrostatic latent image is formed on the insulating sheet. Because charge transport distance is small, high resolution is obtained.

BRIEF DESCRIPTION OF THE DRAWINGS

The invention will be described in more detail hereinafter with reference to the drawings, in which.

DESCRIPTION OF THE PREFERRED EMBODIMENTS

Figure 1:
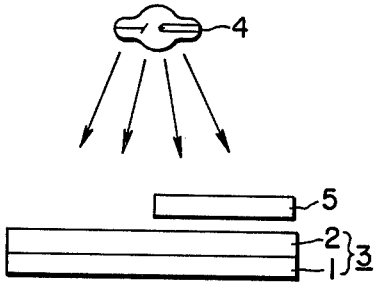
FIG. 1 is a schematic illustration of X-ray irradiation of the exoelectron member.

As shown in FIG. 1, X-rays are irradiated to an object 5 to be inspected placed between an exoelectron emission member 3 comprising a conductive substrate 1 and an exoelectron emissive substance 2 laminated thereon and an irradiation source 4. Effective exoelectron emissive substances 2 used herein includes beryllium oxide incorporated with a minor amount of lithium or sodium. For example, 0.1–5 mol% of lithium compound or sodium compound is added to a beryllium oxide material with a purity of more than 99%. The lithium compound or sodium compound may be sulfates, hydrochlorides, nitrates or any other form. They can be mixed in either a dry or wet manner, but wet mixing is preferred since uniform mixing is possible. The mixture thus obtained is baked more than one hour at a temperature of 1200°–1800° C. in a furnace kept under oxidative atmosphere by flowing air or $O_2$ gas. After the baking, the baked product is left to cool and taken out from the furnace. The baked product is in a form of a white powder or white ceramic depending on the type of the compounds, and the latter is finely divided into powder.

The exoelectron emission member 3 used in this invention comprises a substrate 1 such as aluminum coated with fine powder described above in admixture with a conductive binder such as carbon paste, aluminum paste or the like.

Figure 2A:
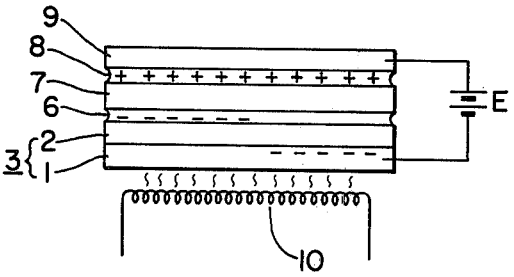
FIGS. 2A and 2B are schematic illustrations of the exposure of the laminate including the exoelectron member to heating or to light irradiation, respectively.
Figure 2B:
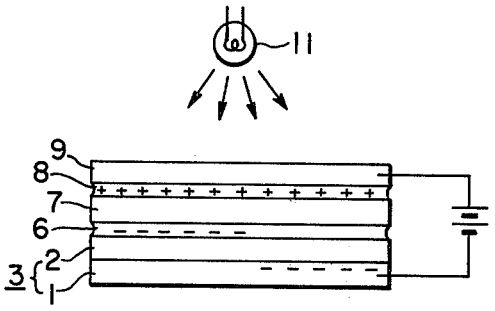

The exoelectron emission member 3 exposed to X-rays is taken out in the dark. The emission member 3 is coated with carrier injection liquid 6 on the surface thereof. Examples of carrier injection liquids which may be used are n-hexane $C_6H_{14}$, carbon tetrachloride $CCl_4$ and kerosene. The coated emission member 3 is then contacted with an insulating sheet 7 for acceptance of carriers. An example of a suitable insulating sheet material is "Mylar", trademark of E. I. Du Pont de Nemours and Co. for polyester films. The insulating sheet 7 is further coated with an electroconductive liquid 8 such as ethyl alcohol or methyl alcohol and overlaid with an electroconductive electrode 9 as shown in FIGS. 2A and 2B. Then, a voltage of 1000–2000 volts is applied between the electroconductive substrate 1 and the electrode 9 using the electrode 9 as a positive electrode. In FIG. 2A, the electrode 9 may be aluminum, and the exoelectron emission member is heated by a heater 10 simultaneously with the voltage application.

Figure 5A:
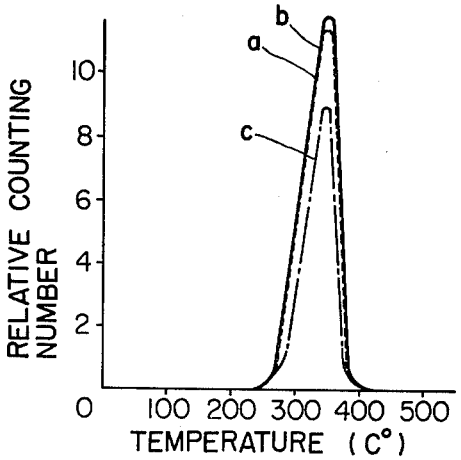
FIGS. 5A and 5B are graphs showing the sensitivity of the exoelectron member as a function of temperature and light exposure time, respectively.

FIG. 5A shows an example of curves obtained by exposing a BeO:Li mixture as an exoelectron emissive substance used in this invention to an irradiation of $^{137}Cs\gamma$ ray at 100 mR wherein curves a, b and c correspond to contents ratios of Li ions to Be ions of 1.1%, 3.1% and 0.05%, respectively, where $Li_2SO_4$ is added in 2 mol% to BeO. As can be seen from the figure, the heating temperature is suitably in the range of 300°–370° C.

Figure 5B:
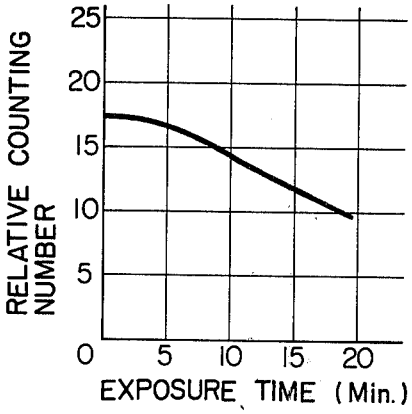

In FIG. 2B electroconductive electrode 9 is a transparent electrode made, for example, by evaporating $SnO_2$ or $In_2O_3$ on glass, and light is irradiated onto the exoelectron emitting member 3 by means of a light source 11 while simultaneously applying a voltage ranging between 1000 to 2000 volts between the conductive base plate 1 and the conductive transparent electrode 9. FIG. 5B is a graphic representation showing the amount of exoelectrons emitted per unit time from an exoelectron emitting substance BeO:Li usable in the present invention as a function of the light irradiation time. As will be understood from this graph, the amount of exoelectrons is substantially constant within the first three minutes of light irradiation but gradually decreases after that. Therefore, when forming an X-ray image as in the present invention, it is necessary to cause stimulation with intense light such as laser light so as to emit exoelectrons within a short time.

Figure 3:
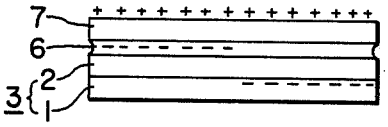
FIGS. 3 and 4 are schematic illustrations showing further steps in the method of preparing X-ray images according to the invention.
Figure 4:
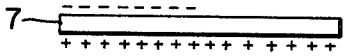

Upon heating or irradiation of light under the application of the voltage as described above, exoelectrons are emitted from the exoelectron emissive substance 2 at the area exposed to the X-ray irradiation and injected into carrier injection liquid 6. Then, electrostatic latent images of negative polarity are formed on the surface of the insulating sheet 7 by the action of the electric field. The application of voltage is thereafter stopped, the conductive electrode 9 is peeled off and the conductive liquid 8 on the surface is evaporated. Since positive carriers are left as they are on the insulating sheet 7 as shown in FIG. 3, a carrier pattern of negative polarity injected into the boundary between the insulating sheet 7 and the exoelectron emissive substance 2 is not disturbed when the insulating sheet 7 is separated from the exoelectron emission member 3. Especially when the carrier injection liquid 6 is insulative, traverse or horizontal diffusion of the carriers is prohibited. Electrostatic latent images are formed on the surface of the separated insulating sheet 7 corresponding to the quantity of the X-rays transmitted through the object as shown in FIG. 4. The electrostatic latent images can be developed into visible images in various developing processes well known to the art of electrophotography. Examples of developing processes which may be used are the electromagnetic brush method as described in U.S. Pat. No. 2,786,440, No. 2,846,333 and No. 2,874,063, the cascade developing method as described in U.S. Pat. No. 2,618,551, No. 2,618,552 and No. 3,105,770, the liquid developing method as described in U.S. Pat. No. 2,899,335, No. 2,907,674, No. 3,032,432 and No. 3,058,914, and the aerosol developing method as described in U.S. Pat. No. 2,725,304, No. 2,759,450 and No. 2,811,135.

According to this invention, X-ray images can be formed by the provision of a simple structure in which an exoelectron emission member, an insulating sheet and a conductive electrode are merely laminated in close contacting relationship, without requiring expensive materials or apparatus, and high resolving power is obtained for the resulting images since the charge transport distance is short.

What is claimed is:

1. A method of forming a radiographic image comprising the steps of irradiating X-rays through a subject, which is to be inspected, to an exoelectron emitting member composed of a conductive substrate and an exoelectron emitting substance thereon;

subsequently, coating the surface of the exoelectron emitting member with a charge injection liquid;

then placing a insulating sheet in intimate contact with the charge injection liquid;

further coating an electroconductive liquid over said insulating sheet and laying an electroconductive electrode thereover; and then effecting heating while applying a voltage between said conductive substrate and said electroconductive electrode thereby forming an electrostatic latent image on said insulating sheet.

2. A method for forming a radiographic image comprising the steps of irradiating X-rays through a subject, which is to be inspected, to an exoelectron emitting member composed of a conductive substrate and a layer of exoelectron emitting substance thereon;

subsequently, coating the surface of the exoelectron emitting member with a charge injection liquid;

then placing a insulating sheet in intimate contact with the charge injection liquid;

further coating the insulating sheet with a conductive liquid; and after superposing a conductive transparent electrode thereon, irradiating light onto the conductive transparent electrode while applying a voltage between the conductive substrate and the conductive transparent electrode, thereby forming an electrostatic latent image on the insulating sheet.

* * * * *